United States Patent [19]

Yang

[11] 4,064,439

[45] Dec. 20, 1977

[54] PHOTOCONTROLLED ION-FLOW ELECTRON RADIOGRAPHY

[75] Inventor: Kei-Hsiung Yang, Schenectady, N.Y.

[73] Assignee: General Electric Company, Schenectady, N.Y.

[21] Appl. No.: 716,088

[22] Filed: Aug. 20, 1976

[51] Int. Cl.[2] ..... G03G 13/00

[52] U.S. Cl. ..... 250/315 A; 250/321; 250/324

[58] Field of Search ..... 250/213 VT, 315, 315 A, 250/321, 324; 357/31

[56] References Cited

U.S. PATENT DOCUMENTS 3,603,790 9/1971 Cleare ..... 250/315 A

*Primary Examiner*—Harold A. Dixon

*Attorney, Agent, or Firm*—Geoffrey H. Krauss; Joseph T. Cohen; Jerome C. Squillaro

[57] ABSTRACT

A method and apparatus for photocontrolled ion-flow electron radiography utilizes a selectably movable phosphor plaque for controlling the selective discharge of a precharged photoconductive layer responsive to differential x-ray absorption in an object to be analyzed, to generate a charge image differentially controlling the deposition of ions upon a film for xerographic recording.

12 Claims, 2 Drawing Figures

10
35
35a
35b
30
12
11
14
30a
19
20
CHARGING MEANS
D
Y
40
18c
27
18a
18b
25
18
18'
S
15
16
17
50
52
T
W
D'

10
35
35a
35b
12
11
14
45
$V_P$
E
P
25'
18c
18a
18a
18b
18c
F
18
15'
50
16
$V_x$
55
52
H
46
41
E
$V'_p$
V
40
ION SOURCE MEANS

PHOTOCONTROLLED ION-FLOW ELECTRON RADIOGRAPHY

BACKGROUND OF THE INVENTION

The present invention relates to x-ray imaging radiography and, more particularly, to a novel method and apparatus for photocontrolled ion-flow electron radiography.

Conventional x-ray imaging techniques, using the screen-film system, are being replaced with xeroradiography, whereby the x-rays differentially absorbed in an object being analyzed cause the deposition of an electrostatic image on an insulative sheet for development by xerographic techniques after exposure. One prior art arrangement for the electrostatic recording of x-ray images utilizes a pair of spaced electrodes with a gas-filled gap therebetween and the first electrode comprising overlayed layers of an ultraviolet-emitting fluorescent material and an air-exposable ultraviolet-sensitive photoemitting material. A plastic sheet is positioned adjacent to the other electrode and an electric field is applied across the gap to accelerate photoelectrons emitted by the photoemitting material and amplified by the gas in the gap, causing an electrostatic image to be formed on the plastic sheet before subsequent xerographic development. This device is disclosed in U.S. Pat. No. 3,940,620, issued Feb. 24, 1976 and assigned to the assignee of the present invention.

It is desirable to eliminate the amplifying gas, for reasons of extraneous noise generation. It is also desired to provide a radiographic system capable of amplifying the differential x-ray image to the greatest extent possible, whereby x-ray dosage to the patient may be reduced.

BRIEF SUMMARY OF THE INVENTION

In accordance with the invention, a method and apparatus for photocontrolled ion-flow electron radiography utilizes a first solid electrode having a conductive layer upon which x-rays, differentially absorbed by an object to be analyzed, impinge and are transmitted therethrough to a second, screen electrode having a photoconductive insulating layer deposited upon the mesh thereof, which photoconductive layer has been pre-charged, prior to the X-ray exposure, with charges of a first polarity. A plaque of phosphor material is moved into substantial abutment with the photo-conductive layer, to convert the incident X-rays to light photons for differentially discharging portions of the photoconductive insulating layer, whereby a charge image of the object is generated upon the screen. The phosphor plaque is then removed and a stream of ions, of like polarity to the polarity of the charges originally deposited on the insulating layer, is directed toward the mesh screen. The ion stream is differentially transmitted, in inverse proportion to the per-unit-area magnitude of the charge image, to an insulative film positioned upon a surface of the first electrode facing the screen; the ions are accelerated toward the film by a field in the region therebetween, with like-charge repulsion allowing ions to be deposited upon the film only as defined by regions of the screen from which charge has been depleted by the differentially-reduced intensity of the X-rays passing through the object under analysis. The magnitude of charge deposited per unit area on the film is controlled by the magnitude of ion flux, which may be continued for relatively long time intervals, consistent with the dark decay time of the photoconductive material, to amplify the charged image deposited thereon to any desired contrast ratio. After deposition of the ion pattern upon the insulating film, development by known xerographic techniques provides a permanent radiograph.

Accordingly, it is one object of the present invention to provide a novel method for radiography utilizing a photocontrolled ion flow.

It is another object of the present invention to provide novel apparatus for accomplishing the novel method of the present invention.

These and other objects of the present invention will become apparent upon consideration of the following detailed description and the accompanying drawings.

DETAILED DESCRIPTION OF THE INVENTION

Figure 1:
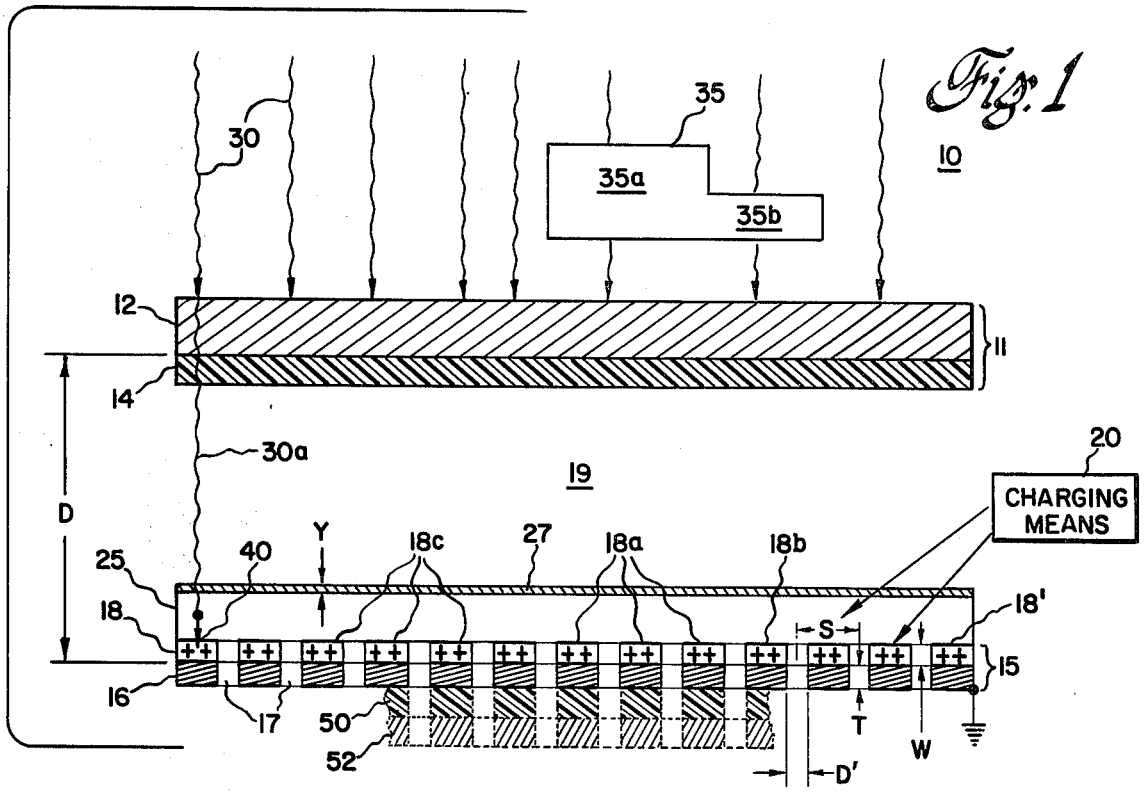
FIG. 1 is a sectional side view of apparatus in accordance with the principles of the present invention, and illustrating the initial steps of the method thereof.

Referring now to the Figures, wherein elements are not drawn to scale, apparatus 10 for controlled ion-flow radiography comprises a first electrode 11 having a substantially planar conductive member 12, preferably formed of a light metal, such as aluminum and the like, transparent to x-radiation. Conductive layer 12 supports a sheet 14 of an insulating material, such as polyester film, Mylar(TM) and the like, upon the conductive sheet surface furthest from the incident x-radiation. Film 14 is disposed so as to be easily removed from layer 12.

A second electrode 15 comprises a screen mesh 16 of a conductive material having a two-dimensional array of microscopic apertures 17 formed therethrough; preferably, the diameter of each aperture is greater than the thickness of the screen (e.g., a preferred screen has a thickness T of about 15 microns, aperture diameter D of about 40 microns and aperture center-to-center spacing S of about 50 microns). A layer 18 of a photoconductive insulating material, such as selenium, cadmium sulphide, zinc oxide, an organic compound and the like, is fabricated essentially only upon that side of the solid portions of screen 16 closest to electrode 11. Preferably, for a layer of selenium, thickness W of about 20 microns is used.

First and second electrodes 11 and 15, respectively, are positioned parallel to one another with photoconductive layer 18 facing the first electrode 11 and with a gap 19 between their interior facing surfaces. Prior to X-ray exposure, at least second electrode 15 is placed in a darkened environment, such as may be obtained by enclosing the volume bounded by electrodes 11 and 15 within an opaque frame (not shown for purposes of simplicity), which frame need not be pressure- or gas-tight, as gap 19 will typically contain air at ambient temperature and atmospheric pressure. Preferably, the enclosure will include a light-sealable slot through which film 14 may ultimately be withdrawn from the apparatus.

Prior to exposure by X-radiation, a charging means 20, such as a corona charger and the like, deposits a quantity of charge, herein illustrated as being of positive polarity, substantially uniformly adjacent the top surface 18' each of the multiplicity of "islands" of insulating photoconductive layer 18. A plaque 25, of a phosphor material emitting light photons responsive to absorption of X-ray quanta therein, is slideably moved into gap 19 and is positioned atop the previously charged photoconductive layer in substantial abutment with the top surfaces 18' thereof. Advantageously, at least during movement, plaque 25 is supported from above by a rigid sheet 27 of a light metal, such as aluminum and the like, substantially transparent to x-radiation. Preferably, metal sheet 27 has a thickness Y on the order of 30 milli-inches when utilized with a plaque having a thickness P between about 5 milli-inches and about 10 milli-inches (for use in medical radiography).

Figure 2:
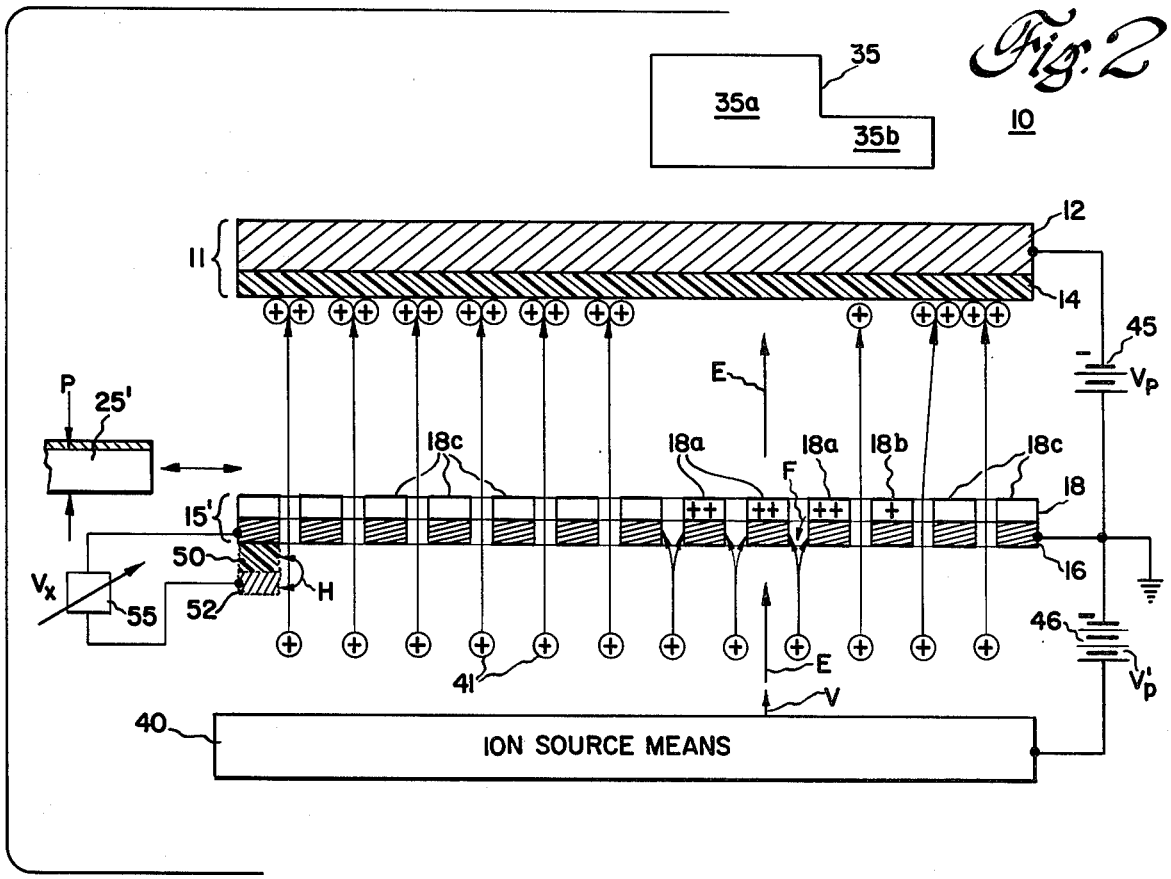
FIG. 2 is a sectional side view of the apparatus of FIG. 1, illustrating the steps required for completion of the novel method in accordance with the principles of the present invention.

A multiplicity of x-ray photons 30 are directed essentially normal to the plane of conductive layer 12, from a source (not shown). An object 35 to be analyzed differentially absorbs the x-ray photons in accordance with the density of, and the path length through, each section of the object. Thus, a relatively thick section **35*a* absorbs relatively more x-ray photons than a relatively thin section 35*b* of the same object, assuming equal x-ray absorption densities, with x-rays passing outside the boundaries of the object being relatively unabsorbed. The differentially absorbed x-rays pass through light metal layer 12 and plastic film 14 of first electrode 11 and continue, as x-rays 30*a*, to impinge upon and be absorbed by the molecules of phosphor plaque 25. Each x-ray photon absorbed by the plaque is converted into a plurality of photons of ultraviolet or visible radiation, in accordance with the x-ray-to-light photon conversion efficiency of the phosphor. The light photons 40 are emitted from phosphor plaque 25 to an underlying "island" of the pre-charged insulating layer. The photoconductive material of layer 18 is thus exposed to light quanta of varying magnitude, in inverse proportion to the absorption of x-ray photons by the object 35 to be analyzed. Relatively few light photons impinge upon those "islands" of the photoconductive layer immediately beneath the relatively thick portion 35*a* of the object, whereby the material of those islands retains its original insulation resistance and essentially all of the charge originally deposited thereat. Other "islands" 18*b* receives a differentially greater magnitude of light photons, as the density and path length of the associated sections 37*b* of the object absorb less of the illuminating x-ray photons; "islands" 18*b* become conductive to a greater or lesser extent, responsive to the magnitude of light photons impinging thereon from phosphor 25, and allow greater and lesser proportions of the previously deposited charge to be conducted through the fibers of mesh 16 to ground. The remaining "islands" 18*c* receive relatively large numbers of light photons as the overlying portions of phosphor plaque 25 are exposed to the essentially unabated flow of X-ray photons from the source; "islands" 18*c* generally receive a sufficient flux of light photons to become highly conductive whereby most, if not all, of the charge previously emplaced thereat is conducted to ground via conductive mesh 16. Thus, after X-ray exposure, the second electrode 15' (FIG. 2) contains a charge image of the object under analysis, with the magnitude of charge at each "island" of the insulating layer 18, over the entire plane of electrode 15**, being inversely proportional to the differential absorption of X-ray photons.

After X-ray exposure, the phosphor plaque 25' is withdrawn from the gap until all "islands" of the charge layer are uncovered. An ion source means 40 generates a stream of ions, of like polarity to the charges deposited upon insulating layer 18, with substantially uniform distribution over the entire plane of mesh 16. Potential sources 45 and 46 of respective magnitudes $V_p$ and $V_p'$ are coupled respectively between first electrode conductive layer 12 and mesh 16 and mesh 16 and ion source means 40 to establish an electric field E. The polarity of both sources 45 and 46 are established to cause ions 41 to be accelerated from ion source means 40 through screen electrode 15 toward upper electrode 11. Illustratively, if charging means 20 initially deposits positive-polarity charges at insulating layer 18, then ion source means 40 generates a stream of positively-charged ions 41 and metallic layer 12 is maintained at a negative potential with respect to screen 15, which is also maintained at a negative potential with respect to ion source means 40.

The intensity of the streams of ions are controlled by the magnitude of the emission velocity V, the magnitude of the accelerating electric field E and by a fringe field F produced by the residual charge at each "island" of the photoconductive insulating layer, which field is, in the vicinity of an aperture, of opposite direction to the accelerating field E and modulates the effective diameter of the aperture proportional to the magnitude of charge at layer 18, to gate the ion flow through each aperture 17. The relatively fully charged islands **18*a*, having charges of like polarity to the ions, generate a fringe field F of magnitude sufficient to cause the ions to be fully repelled or to impinge upon grounded conductive mesh 16, whereby relatively few of the ions pass through the apertures 17 associated with these "islands" and thus deposit relatively little charge on the overlying areas of film 14. The fringing electric field in apertures 17 associated with regions of lesser-charged "islands" 18*b* provides a greater effective aperture to allow proportionately greater numbers of like-charged ions to pass through those apertures 17 to deposit proportionately greater amounts of charge on the overlying portions of the film 14, as associated with the proportionately greater X-ray photon transmissivity of object portion 35*b*. The remaining "islands" of insulating layer 18*c* being relatively devoid of charge and, therefore, of any fringing aperture field associated therewith, allow a relatively large portion of the incident ions 41 to pass through the associated apertures and be deposited at film 14. The charge image formed upon second electrode 15' is thus inversely reproduced upon sheet 14, but with proportionately greater charge amplitude directly dependent upon the flux of ions 41 directed toward the second electrode and modulated by the initial charge image thereon. Thus, the relatively small amount of charge induced at insulating layer 18** can control a relatively large ion flow, within any time interval up to the dark decay time of the photoconductive insulator layer (after which decay time the initial charge image begins to deplete and may not represent the x-rayed object in true detail). Therefore, a relatively low x-ray amplitude may be used to generate a charge pattern of amplitude sufficient to be made visible by subsequent application of a toner material and development by xerographic techniques.

It should be understood that a somewhat greater range of charge intensities, and hence contrast, may be achieved at film 14 by utilizing known four-layer second electrodes having an apertured insulating sheet 50 (shown in broken line) disposed upon the free surface of the entire mesh 16 and having a conductive apertured sheet 52 (also shown in broken line), of similar size and shape, upon a surface of sheet 50 furthest from mesh 16, with the apertures of both sheets 50 and 52 in registraton with each other and with apertures 17 of the mesh and photo conductive layer. A second potential source 55, of variable magnitude and polarity, is coupled between mesh 16 and conductive layer 52 to deposit charges at the latter layer of polarity with respect to the charges of ions 41, to develop either a decelerating (like polarity) or an accelerating (opposite polarity) electrostatic bias field H within each aperture 17, in addition to X-ray responsive field F, whereby the average aperture encountered by the ions (with no charge at photoconductive layer 18) may be preset to a desired value to establish an average value of ion flux therethrough.

While the present invention has been described with reference to a particular embodiment thereof, many other variations and modifications, especially that of depositing negative charges initially in photoconductive layer 18 and utilizing negative ions, will become apparent to those skilled in the art. It is my intention, therefore, to be limited not by the specific embodiment disclosed herein, but only by the scope of the appending claims.

What is claimed is:

1. A method for photocontrolled ion-flow electron radiography comprising the steps of:

a. providing a mesh screen having a layer of a photoconductive insulating material fabricated upon only one surface thereof;

b. depositing a quantity of electrical charge of a first polarity substantially uniformly adjacent the top surface of the entire photoconductive layer;

c. moving a plaque of a phosphor material into substantially abutting relationship against the charged photoconductive layer;

d. illuminating the phosphor plaque with x-rays differentially absorbed by an object to be analyzed, to cause said phosphor plaque to convert the X-rays to light photons for differentially modifying the conductivity of a plurality of portions of the charged photoconductive layer to create a charge image thereon of magnitude proportional to the absorption of said X-rays by said object;

e. removing said phosphor plaque;

f. providing an insulating film spaced from and parallel to the layer of photoconductive material;

g. accelerating a stream of ions having said first polarity sequentially toward the surface of the screen devoid of the photoconductive layer and thence towards the insulating film, to provide a charge image upon the film modulated by the charge image in the photoconductive layer upon said screen and substantially inversely proportional thereto; and h. developing the charge image on said film by xerographic techniques to provide a radiograph of said object.

2. A method as set forth in claim 1, further including the step of substantially excluding all ambient light from said photoconductive layer during the depositing, illuminating and accelerating steps.

3. A method as set forth in claim 1, wherein the photoconductive material covers essentially only the solid portions of said only one surface of the mesh of said screen.

4. A method as set forth in claim 1, wherein said phosphor plaque is adapted for sliding movement with respect to said photoconductive layer.

5. A method as set forth in claim 1, further comprising the step of providing a variable biasing electric field in the region around each aperture of the mesh screen to adjustably preset the average value of ion flux therethrough.

6. Apparatus for use in the radiographic analysis of an object differentially absorbing X-ray photons, comprising:

a first electrode supporting a sheet of insulating material;

a conductive mesh electrode spaced from said first electrode to form a gap therebetween;

a layer of a photoconductive insulating material fabricated upon only that surface of said mesh electrode facing said first electrode;

means for depositing a quantity of a first polarity of electrical charge substantially uniformly adjacent a surface of said photoconductive layer facing said gap;

a plaque selectively movable into and out of abutment with substantially all of the surface of said photoconductive layer, said plaque being fabricated of a phosphor material emitting light photons responsive to the differentially absorbed X-rays to cause each of a plurality of regions of said photoconductive layer to be differentially depleted of the charge stored thereat;

means for emitting a stream of ions of said first polarity toward a surface of said mesh electrode devoid of said photoconductive layer; and means for applying an electric field across the gap for accelerating said ions toward said insulating film after said phosphor plaque has been removed from said gap; said ions being transmitted through the apertures of said mesh electrode in inverse proportion to the magnitude of charge contained in areas of said photoconductive layer adjacent to each aperture to create a charge image upon said film inversely proportional to the differential absorption of the X-rays by said object.

7. The apparatus as set forth in claim 6, wherein said photoconductive material is fabricated essentially only upon the solid portions of said only one surface of said mesh.

8. Apparatus as set forth in claim 6, wherein said mesh electrode is maintained at electrical ground potential.

9. Apparatus for use in the radiographic analysis of an object differentially absorbing X-ray photons, comprising:

a first electrode supporting a sheet of insulating material;

a conductive mesh electrode spaced from said first electrode to form a gap therebetween;

a layer of a photoconductive insulating material fabricated upon a surface of said mesh electrode facing said first electrode;

means for depositing a quantity of positive electrical charge substantially uniformly adjacent a surface of said photoconductive layer facing said gap;

a plaque selectively movable into and out of abutment with substantially all of the surface of said photoconductive layer, said plaque being fabricated of a phosphor material emitting light photons responsive to the differentially absorbed X-rays to cause each of a plurality of regions of said photoconductive layer to be differentially depleted of the charge stored thereat;

means for emitting a stream of positive ions toward said mesh electrode and means for applying an electric field across the gap for accelerating said ions toward said insulating film after said phosphor plaque has been removed from said gap; said ions being transmitted through the apertures of said mesh electrode in inverse proportion to the magnitude of charge contained in areas of said photoconductive layer adjacent to each aperture to create a charge image upon said film inversely proportional to the differential absorption of the X-rays by said object.

10. Apparatus as set forth in claim 9, wherein said first electrode further comprises a conductive member supporting a surface of said insulating film furthest from said mesh electrode; and said field applying means comprises first and second sources of electrical potential coupled between said mesh electrode and each of said conductive member and said ion emitting means, said first and second sources having polarities to maintain said conductive member and said ion emitting means respective more electrically negative and more electrically positive than said mesh electrode.

11. Apparatus for use in the radiographic analysis of an object differentially absorbing X-ray photons, comprising:

a first electrode supporting a sheet of insulating material;

a conductive mesh electrode spaced from said first electrode to form a gap therebetween;

a layer of a photoconductive insulating material fabricated essentially only upon the solid portions of the surface of said mesh electrode facing said first electrode, said layer having a planar surface;

means for depositing a quantity of a first polarity of electrical charge substantially uniformly adjacent a surface of said photoconductive layer facing said gap;

a plaque having a complementary planar surface to facilitate sliding said plaque into and out of said gap and into and out of substantial abutment with substantially all of the planar surface of said photoconductive layer, said plaque being fabricated of phosphor material emitting light photons responsive to the differentially absorbed X-rays to cause each of a plurality of regions of said photoconductive layer to be differentially depleted of the charged stored thereat;

means for emitting a stream of ions of said first polarity toward said mesh electrode; and means for applying an electric field across the gap for accelerating said ions toward said insulating film after said phosphor plaque has been removed from said gap; said ions being transmitted through the apertures of said mesh electrode in inverse proportion to the magnitude of charge contained in areas of said photoconductive layer adjacent to each aperture to create a charge image upon said film inversely proportional to the differential absorption of the X-rays by said object.

12. Apparatus for use in the radiographic analysis of an object differentially absorbing X-ray photons, comprising:

a first electrode supporting a sheet of insulating material;

a conductive mesh electrode spaced from said first electrode to form a gap therebetween;

a layer of a photoconductive insulating material fabricated essentially only upon the solid portions of the surface of said mesh electrode facing said first electrode, said layer having a planar surface;

means for depositing a quantity of a first polarity of electrical charge substantially uniformly adjacent a surface of said photoconductive layer facing said gap;

a plaque having a complementary planar surface to facilitate sliding said plaque into and out of said gap and into and out of substantial abutment with substantially all of the planar surface of said photoconductive layer, emitting light photons responsive to the differentially absorbed X-rays to cause each of a plurality of regions of said photoconductive layer to be differentially depleted of the charged stored thereat;

a sheet of substantially rigid material substantially transparent to x-radiation and supporting said plaque during at least movement thereof;

means for emitting a stream of ions of said first polarity toward said mesh electrode; and means for applying an electric field across the gap for accelerating said ions toward said insulating film after said phosphor plaque has been removed from said gap; said ionss being transmitted through the apertures of said mesh electrode in inverse proportion to the magnitude of charge contained in areas of said photoconductive layer adjacent to each aperture to create a charge image upon said film inversely proportional to the differential absorption of the X-rays by said object.

* * * * *